United States Patent [19]

Ethridge

[11] 4,211,307

[45] Jul. 8, 1980

[54] REMOVABLE STEP OR SHELF FOR LADDER

[76] Inventor: Frank W. Ethridge, 4737 S. Harvard,#B, Tulsa, Okla. 74135

[21] Appl. No.: 17,349

[22] Filed: Mar. 5, 1979

[51] Int. Cl.[2] ..... E06C 7/16; E06C 7/14

[52] U.S. Cl. ..... 182/121

[58] Field of Search ..... 182/121, 120, 122; 248/238, 242

[56] References Cited

U.S. PATENT DOCUMENTS

| | | | |
|---|---|---|---|
| 362,747 | 5/1887 | Higgins | 182/121 |
| 407,079 | 7/1889 | Laskey | 182/121 |
| 2,282,133 | 5/1942 | Horton | 182/121 |
| 2,432,206 | 12/1947 | Mott | 182/121 |
| 2,578,862 | 12/1951 | Tims | 182/121 |

*Primary Examiner*—Reinaldo P. Machado

*Attorney, Agent, or Firm*—Head & Johnson

[57] ABSTRACT

A removable step for a ladder having a base member dimensioned to function as a seat or shelf, including an upward extending hanging member attachable at the upper end to a ladder rung, the lower end being pivoted to the base rearward edge, a downwardly extending support member having a lower end attachable to a ladder rung, the upper rung being pivoted to the base member forward edge, and a retaining bar having the rearward end attached to the base member lower rearward edge, the retaining bar extending underneath the base member and having two spaced apart indentures for removably engaging a ladder rung, the retaining bar serving to keep the base member forwardly pivoted so that it functions as a seat or shelf or rearwardly positioned so that it functions as a step.

4 Claims, 2 Drawing Figures

REMOVABLE STEP OR SHELF FOR LADDER

BACKGROUND AND OBJECTS OF THE INVENTION

Those who use ladders encounter the problem of finding a place to set items such as paint, tools, and so forth. In some instances when a ladder is used for working at an elevation, it is very helpful to have a comfortable seat. For those purposes, the present invention is directed towards a removable shelf which also functions as a seat or step.

It is therefore an object of this invention to provide an improved shelf for a ladder. More particularly, an object of this invention is to provide an improved removable shelf for a ladder which is quickly and easily attached to a ladder without requiring the use of tools.

Another particular object of this invention is to provide a removable shelf for a ladder in which the shelf can be positioned above a rung of the ladder with an upwardly extending hanging member pivotably attached to the rung immediately above and a downwardly extending support member pivotably attached to the rung immediately below and in which the shelf may be pivoted outwardly to function as a seat or shelf or pivoted inwardly so as not to obstruct the normal use of the ladder, thereby permitting the user to walk upwardly above the shelf or downwardly below it without removing it from the ladder.

An important element of the invention is a removable shelf for the purpose immediately above described and including a retaining bar which functions to retain the shelf in an inward or outward position.

DESCRIPTION OF THE VIEWS

SUMMARY OF THE INVENTION

This invention provides a removable shelf for use with a ladder having opposed side rails and spaced apart rungs extending between the side rails. The removable shelf includes a base member of length less than the spaces between the ladder side rails. The base member provides a flat upper surface, the width being sufficient to afford a seat or shelf. The base portion has a forward edge and a rearward edge. An upwardly extending hanging member is pivotally attached to the base member rearward edge. The upper end of the hanging member is configured to engage a rung of the ladder, such as by an inverted U-shape or hook configuration which allows the hanging member to be removably and pivotally supported to the ladder rung. A downwardly extending support member is pivotally attached to the base forward edge and has inverted U-shaped lower ends for removably and pivotally engaging a ladder rung. The removable shelf is designed to be positioned on a ladder immediately above a ladder rung with the hanging member pivotally attached to the next adjacent upper rung and the support member pivotally supported on the next adjacent lower rung. A retaining bar is pivotally affixed to the base rearward edge and has two inverted U-shaped portions which engage the ladder rung adjacent and immediately below the base, the first portion serving to retain the base in an outward position where it functions as a seat or shelf and the other inverted U-shaped portion serving to retain the base in the inner position where it functions as a step so that it does not interfere with the normal use of the ladder.

DETAILED DESCRIPTION

Figure 1:
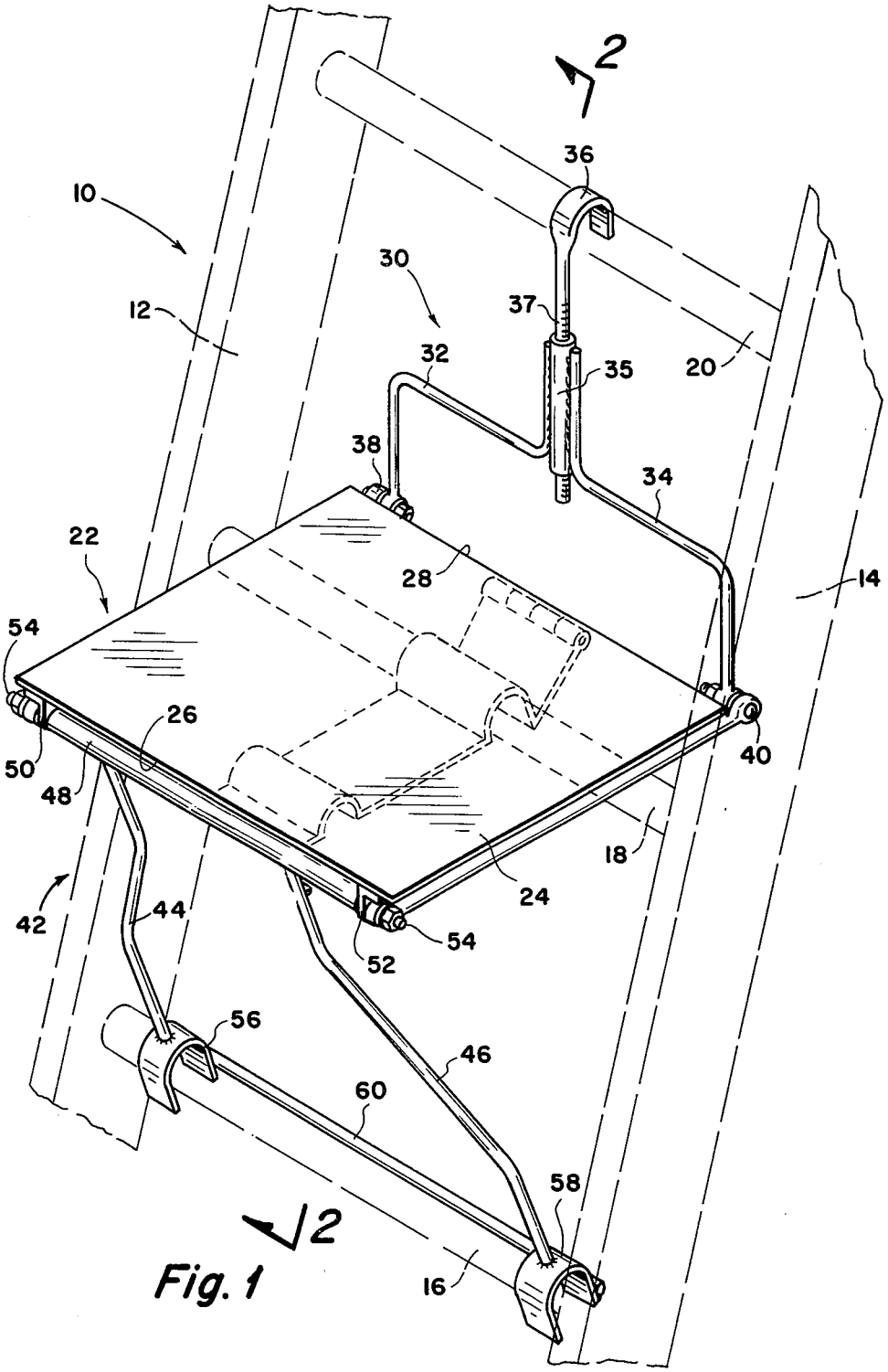
FIG. 1 is an isometric view of the removable shelf of this invention shown supported on a ladder illustrated in dotted outline. The shelf is shown in the forward position wherein it functions as a seat or shelf to receive paint, tools, etc. thereon.

Referring to the drawings and first to FIG. 1, a ladder is illustrated in dotted outline and generally indicated by the numeral 10. The ladder includes side rails 12 and 14 and spaced apart rungs 16, 18 and 20. While the ladder rungs 16, 18 and 20 are shown as being of the round type, it is understood that they may be of any other cross-sectional configuration. The invention is directed towards a removable shelf, being indicated generally by the numeral 22, for positioning on ladder 10. Shelf 22 includes a base member 24 which is of a length less than the spacing between the ladder side rails 12 and 14. The base member provides a flat upper surface of a width being sufficient to afford a seat or shelf. The base member 24 has a forward edge 26 and a rearward edge 28.

A hanger member is generally indicated by the numeral 30 and is pivotally attached at the base member rearward edge 28. In the illustrated arrangement, the hanging member includes a first bar 32 pivotally attached at its lower end to the base member rearward edge 28 and a second bar 34 which is also pivotally attached at its lower end to the base member. The bars 32 and 34 are spaced apart at the bottom and are bent to attach to an internally threaded tubular member 35. A hook portion 36 is configured to engage ladder rung 20. The hook portion 36 is of an inverted U-shaped configuration at the upper end so that it easily clips onto rung 20 and is pivotal. The hook portion 36 has a downwardly extending externally threaded portion 37 which is threadably received in the tubular member 35. The lower ends of rods 32 and 34 are shown as being pivotally connected to the shelf member by bolts 38 and 40. By rotating hook 36 the threaded portion 37 received in tubular member 35 may be varied, thereby varying the length of hanger member 30 so that the shelf may be adjusted to different rung spacings.

Pivotally attached to the base member forward edge 26 is a downwardly extending support member generally indicated by the numeral 42 which is in the form of a first rod 44 and a second rod 46. The upper end of each rod 44 and 46 is affixed to a horizontal tube 48 which extends between spaced structural angle members 50 and 52. A bolt 54 extends through the tube 48 and through openings (not shown) in the structural members 50 and 52 to pivotally support member 42.

At the lower end of each of rods 44 and 46 is a U-shaped element 56, and in like manner, at the lower end of rod 46 is the U-shaped element 58. Elements 56 and 58 are configured to engage ladder rung 16 to permit support member 42 to pivot relative to the ladder. To maintain the lower ends of rods 44 and 46 at their preselected spacing, a rod 60 is affixed, such as by welding, to the rearward side of the U-shaped elements 56 and 58.

Figure 2:
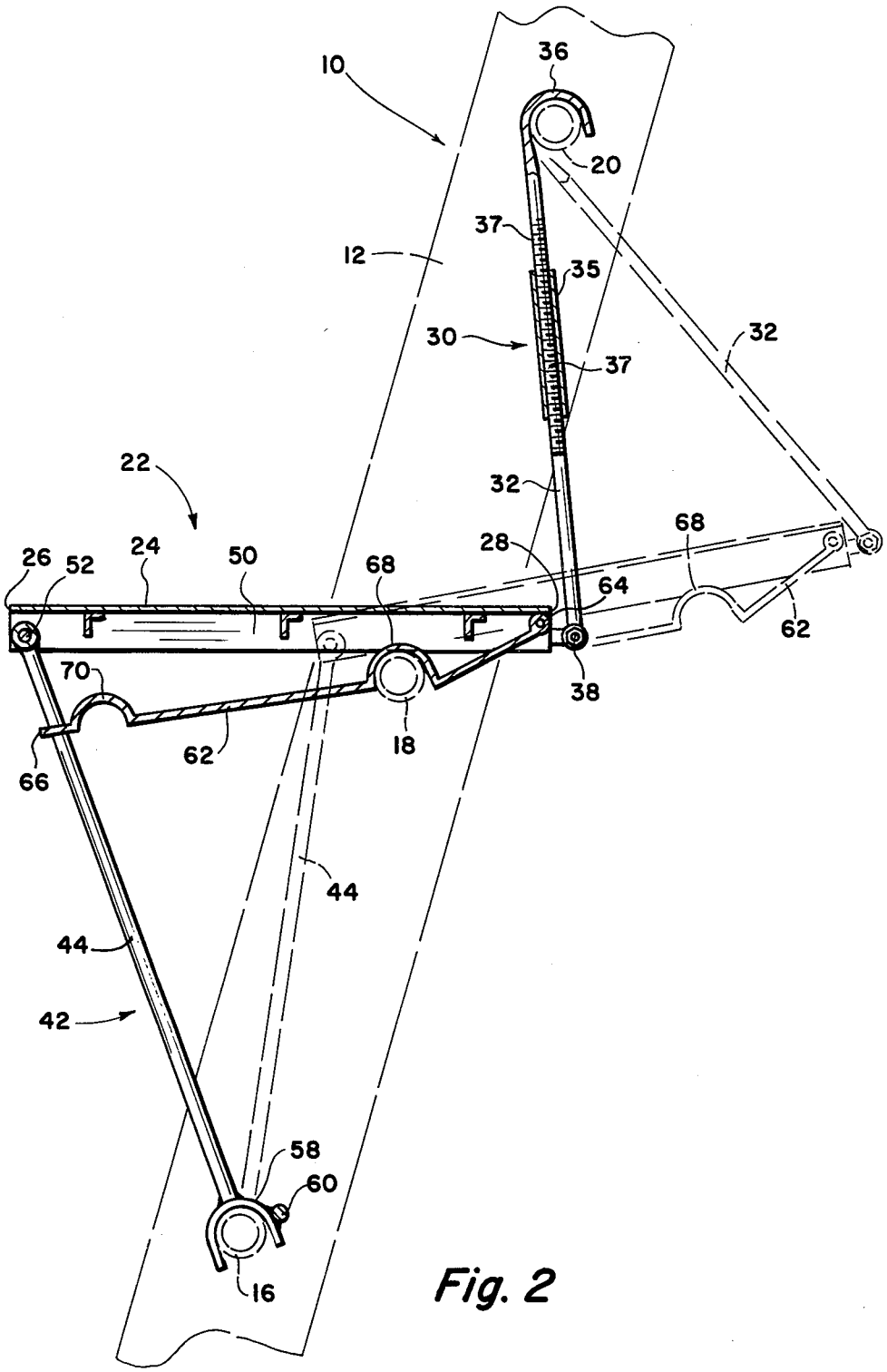
FIG. 2 is a cross-sectional view taken along the line 2—2 of FIG. 1 and showing in solid outline the shelf in the forward direction where it functions as a seat or shelf, and in dotted outline when pivoted to the rearward position wherein it functions as a step.

Pivotally affixed to the lower surface of base member 24, adjacent the rearward edge 28, is a retaining bar 62, best shown in FIG. 2. The retaining bar is pivoted to the base member 24 by means of a pin 64. The retaining bar has a forward end 66. Integrally formed in the retaining bar is a first inverted U-shaped portion 68 and, spaced from it, a second inverted U-shaped portion 70. The U-shaped protions 68 and 70 are configured to engage ladder rung 18. The first U-shaped portion 68 engages the ladder rung when the base member 24 is pivoted to the outward position as shown in solid outline in FIG. 2 and the second integral inverted U-shaped portion 70 engages ladder rung 18 when the base member is pivoted rearwardly as shown in dotted outline in FIG. 2.

When the operator desires to use the removable shelf of this invention, he can easily carry it up the ladder after the ladder is positioned for use, the weight of the shelf being minimal since it requires a minimum amount of structural material. The user first places the hook portion 36 of hanger 30 on ladder rung 20. He then next places the inverted U-shaped elements 56 and 58 of support member 42 on ladder rung 16. This places the base portion 24 immediately above the intermediate ladder rung 18. By the downward pivotal propinsity of retaining bar 62, one of the inverted U-shaped portions 68 or 70 will engage ladder rung 80. When the shelf is to be used to support paint, tools, or so forth, or form a seat, the shelf is moved to the forward position as shown in solid outline with the integral U-shaped portion 68 of the retaining bar engaging rung 18. The shelf will remain in this position. When the user wants to step up the ladder past the shelf, he can merely pivot the retaining bar 62 upward by engaging the upper end with his hand if he is standing below the shelf or with his foot if he is standing above the shelf. After the retaining bar is raised, the operator can move the shelf inwardly to the dotted position. The retaining bar will maintain the shelf in this selected position and the user can step on the shelf as if it was a rung of a ladder and thereby move up and down the ladder past the shelf without interference.

To remove the ladder, he merely lifts the hanger member 30 from engagement with rung 20 and the downwardly extending support member 42 from engagement with rung 16 and carries the portable shelf back down the ladder.

When used as a shelf, seat or step, the device improves safety since the weight of the user is supported in part by ladder rungs 16, 18 and 20. This decreases the possibility that the weight of the user will break a rung when a single rung is required to support the user's full weight.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. For use with a ladder having opposed side rails and spaced apart rungs extending between the side rails, a removable shelf comprising:

a base member of length less than the spacing between the ladder side rails, the base member providing a flat upper surface, the width being sufficient to afford a step, seat or shelf, the base portion having a forward edge and a rearward edge;

an upward extending hanger member having an upper end and a lower end, the lower end being pivotally attached to said base member adjacent the rearward edge thereof, the upper end having a hook portion for removably and pivotally engaging a ladder rung;

a downwardly extending support member having an upper end and a lower end, the upper end being pivotally attached to said base member adjacent the forward edge thereof, the lower end having means for removably and pivotally engaging and ladder rung; and a retaining bar having a forward end and a rearward end, the bar being pivotally attached below the base member and adjacent the rearward edge thereof, the retaining bar having means intermediate the ends thereof for removably engaging a ladder rung and for disengaging the ladder rung when the forward end is upwardly pivoted, the apparatus being dimensioned whereby the base member may be supported immediately above a ladder rung with the upper end of the hanger member attached to the next adjacent upper ladder rung and lower end of the support member attached to the next adjacent lower ring, said support bar serving to retain the base member in at least one preselected position relative to the rung immediately below it.

2. A removable shelf for a ladder according to claim 1 wherein said retaining bar has two means intermediate the ends thereof for removably engaging a ladder rung, one of the means being positioned to engage a ladder rung to retain the base member outwardly in a position to function as a shelf, and the other means being positioned to engage a ladder rung to retain the base member inwardly whereby the base member does not obstruct the ladder permitting the user to climb past the removable step.

3. A removable shelf for a ladder according to claim 2 wherein said retaining bar two means for removably engaging a ladder rung include the retaining bar being configured in vertical cross-section by integral upwardly extending portions configured to engage the upper surface of the ladder rung.

4. A removable shelf for a ladder according to claim 1 wherein the length of upwardly extending hanger member is adjustable.

* * * * *